US005531359A

United States Patent [19]

Winner

[11] Patent Number: 5,531,359

[45] Date of Patent: Jul. 2, 1996

[54] HOLDER FOR PERSONAL PROTECTION DEVICES

[75] Inventor: Kevin Winner, Hermitage, Pa.

[73] Assignee: Guardian Royalty Corporation, Sharon, Pa.

[21] Appl. No.: 345,632

[22] Filed: Nov. 25, 1994

[51] Int. Cl.[6] ..... B67D 5/33

[52] U.S. Cl. ..... 222/153.11; 222/183; 42/1.08

[58] Field of Search ..... 222/153.13, 153.11, 222/402.11, 162, 175; 224/914; 42/1.08

[56] References Cited

U.S. PATENT DOCUMENTS

| | | | |
|---|---|---|---|
| 3,445,046 | 5/1969 | Wilson | 224/26 |
| 3,450,313 | 6/1969 | Jonas | 222/402.13 |
| 3,474,939 | 10/1969 | O'Donnell et al. | 222/320 |
| 3,863,814 | 2/1975 | Shelton | 222/153 |
| 4,024,988 | 5/1977 | Starrett | 222/153 |
| 4,044,922 | 8/1977 | Bordelon | 222/402.11 |
| 4,220,263 | 9/1980 | Caruso | 222/183 |
| 4,223,804 | 9/1980 | Morris et al. | 42/1.08 |
| 4,301,947 | 11/1981 | Potter | 222/182 |
| 4,324,351 | 4/1982 | Meshberg | 222/402.11 |
| 4,434,914 | 3/1984 | Meshberg | 222/153 |
| 4,449,474 | 5/1984 | Mariol | 116/2 |
| 4,454,966 | 6/1984 | Hicks | 222/153 |
| 4,776,491 | 10/1988 | Nitta | 222/153 |
| 4,872,084 | 10/1989 | Dunnis et al. | 361/232 |
| 4,982,645 | 1/1991 | Abboud | 42/1.08 |
| 5,070,611 | 12/1991 | Derin et al. | 30/41 |
| 5,111,968 | 5/1992 | Wilkerson | 222/47 |
| 5,310,086 | 5/1994 | Julinot | 222/1 |
| 5,348,193 | 9/1994 | Bruckner et al. | 222/175 |
| 5,366,118 | 11/1994 | Ciammitti et al. | 222/153 |

*Primary Examiner*—Andres Kashinikow
*Assistant Examiner*—Philippi Derakshani
*Attorney, Agent, or Firm*—Vickers, Daniels & Young

[57] ABSTRACT

An automatic disarming device for use with a portable personal protection apparatus in which the device disarms when taken from an authorized user thereby rendering the device ineffective or inoperative when turned against the authorized user. The automatic disarming device includes a housing supporting the personal protection apparatus, an operating mechanism on the housing for actuating the personal protection apparatus, and a removable arming member which renders the operating mechanism inoperative or ineffective when the arming member is separated from the housing.

30 Claims, 6 Drawing Sheets

FIG. 3
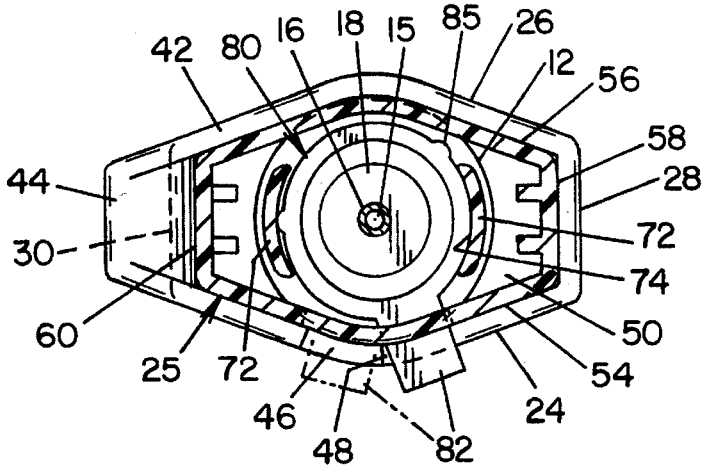
FIG. 4
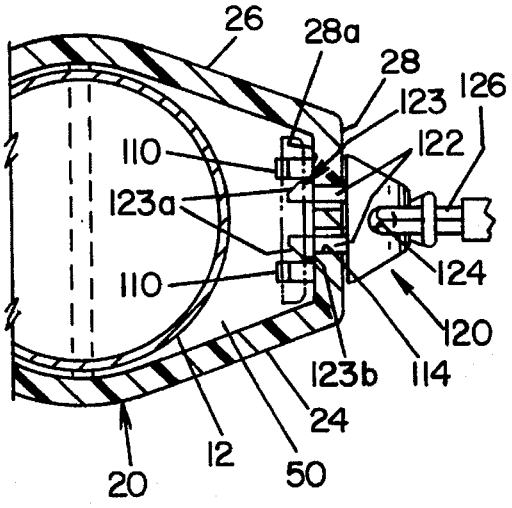
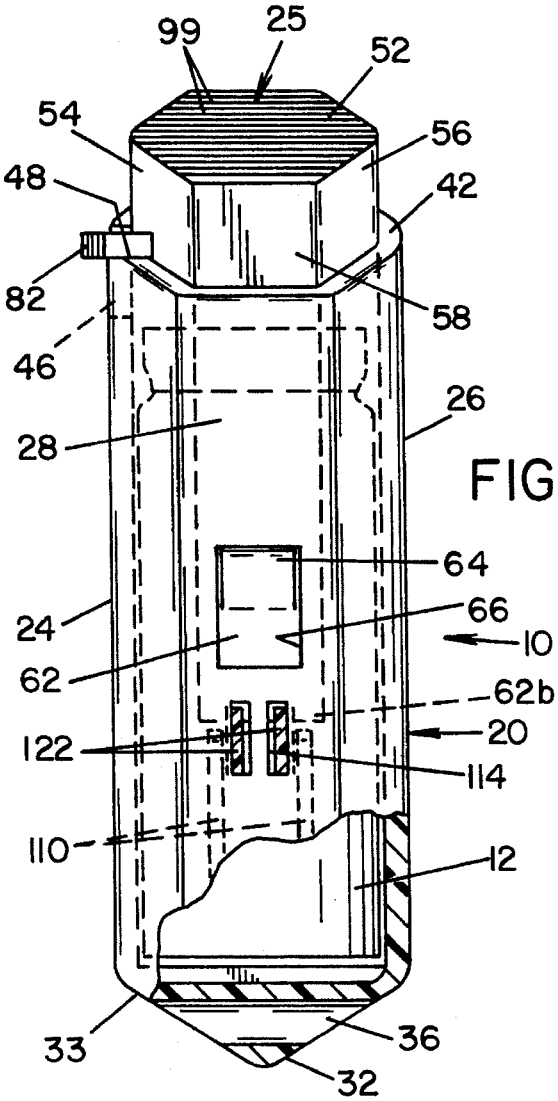
FIG. 5

HOLDER FOR PERSONAL PROTECTION DEVICES

U.S. application Ser. No. 08/054,148 filed Apr. 30, 1993 now U.S. Pat. No. 5,366,118 illustrates a housing for aerosol protection devices similar to the type of housing this invention relates is incorporated herein by references.

BACKGROUND OF THE INVENTION

The present invention relates to the art of personal protection devices and, more particularly, to an improved holder for a personal protection device which has a disarming feature to prevent the unauthorized operation of the device.

The present invention is particularly applicable to aerosol and electric shock type personal protection devices and will be described with particular reference thereto; however, the invention has much broader application and may be used with a variety of other aerosol products, protective devices and security products when it is desired to protect against unauthorized activation thereof.

Many consumer products are provided or are packaged in aerosol containers, the contents of which are dispersed or dispensed by depressing an actuating valve on the container. Typical examples of such products which are packaged in this manner are perfumes, colognes, breath fresheners, hair sprays, insect repellents and the like. Another type of product provided in an aerosol container is a personal security device containing a self-defense spray and which can be easily carried by a user in a pocket or handbag. The device is grasped, and when actuated, will discharge an aerosol chemical spray such as mace or pepper gas to deter an attacker or assailant. Various types of deterrent chemicals are commercially available in aerosol form as personal defense products and one of the more popular is a capsicum or pepper composition of the type sold under the trademark BODYGUARD by Guardian Products of Phoenix, Ariz.

Several problems are attendant to the use of aerosol containers and particularly those which serve as personal defense products. Aerosol products of this type must be convenient to use so that the consumer can carry the dispenser in a pocket or purse in a manner so that the aerosol device can be quickly and easily retrieved and actuated. It is also desirable to protect the aerosol canister so that it is not unintentionally or inadvertently actuated. The device should also be designed so that when retrieved, it can be quickly oriented with the discharge nozzle properly aimed which orientation should be able to be accomplished tactilely or by feel without the user having to visually check the proper position of the aerosol device. The device further should be rendered ineffective or inoperative when such device has been taken away from the authorized user or removed from a stored position or location without the permission of the user to prevent such devices from accidently discharging or be used against the authorized user.

Various containers or holders for security devices can be found in the prior art. In Application Ser. No. 08/054,148, filed Apr. 30, 1993 now U.S. Pat. No. 5,366,118, a dispenser for aerosol container which dispenser has a locking feature to prevent the unintentional or inadvertent release of the contents of the aerosol container. However, the dispenser does not include a disabling feature to prevent one other than the authorized user from discharging the contents of the aerosol container.

U.S. Pat. No. 5,310,086 shows a canister holder which disarms the canister when the canister support is removed from the canister holder, but is not a reusable holder and is difficult to rearm after being disarmed.

U.S. Pat. No. 5,111,968 discloses a hand-held tear gas canister and personal security device having an elongated ridge or rib on the outer surface of the canister or on a holster to facilitate orientation of the canister. The dispenser does not include a disarming mechanism.

U.S. Pat. No. 4,872,084 discloses a typical electric shock type personal protection device which applies a non-fatal shock to an assailant to temporarily disable or disorient the assailant. The device does not include a disarming and rearming mechanism.

U.S. Pat. No. 4,454,966 shows a case for enclosing an aerosol dispenser. The case conforms to the form of the aerosol and is designed particularly to conform to the actuator of the aerosol dispenser to permit operation of the dispenser while the dispenser is contained within the case. The case is absent a mechanism for disarming the aerosol cannister.

U.S. Pat. No. 4,449,474 discloses a personal security device which comprises a trigger-actuated aerosol canister contained in a two-piece telescoping house. A mechanism for disarming the security device is not disclosed.

U.S. Pat. No. 4,301,947 shows a device which is to be added to a tear gas canister which fits over the canister and provides a guiding tunnel over the discharge button so that by feel alone, the device may be properly grasped and actuated by depressing the button with the user's finger. The device does not include a disarming mechanism.

U.S. Pat. No. 3,863,814 discloses a safety cap for aerosol cans incorporating a central split cylinder having hooked ends. The hooked ends are locked beneath the can bead by a ring which may be slid downwardly on the sections to lock the device. Release of the hooked ends is affected by upwardly sliding the ring and depressing the cap to outwardly flex the hooked ends. Upon retraction of the hooked ends, the cap can be lifted from the can. The device is intended primarily as a safety cap for aerosol cans. The device does not include a disarming and rearming mechanism.

U.S. Pat. No. 3,450,313 discloses a spring metal holding clip for aerosol containers having an end that is made to snugly fit in the annular recessed top of the container to resist upward displacement. The plastic cap fits around the top portion of the container having a slot through which the spring clip extends. With the clip in this position, the user, by touch, can properly direct the spray nozzle. A mechanism for disarming the cap to prevent release of the container contents by an unauthorized person is not disclosed.

U.S. Pat. No. 3,445,046 shows a holster for holding an aerosol container which holster has an opening for discharge of fluid from the container. An access opening to a valve actuator on the container is provided along with means to hold or clip the holster on the belt while also allows quick detachment. A disarming mechanism is absent from the holster.

While, as indicated above, there are a number of various types of holsters, containers and the like for various types of aerosol and electric shock devices, particularly those of the personal defense type, there is absent from the art of disarming arrangement which is reliable and simple to operate. In view of the dispensers or holders to date, exists a need for an improved dispenser or holder which is structurally simple and easy to manufacture, convenient to use, assists in properly orienting the discharge spray or other types of security products, provides a locking feature to minimize the possibility of inadvertent or accidental discharge of the aerosol spray or activation of other security products, and which also provides a quick and easy method of arming and disarming the aerosol spray, electric shock mechanism or other personal protection products.

SUMMARY OF THE INVENTION

The present invention relates to an apparatus for disarming personal protection devices which renders such devices ineffective or inoperable when such devices are used by unauthorized persons. The disarming mechanism can be both a safety feature as well as a disarming feature for a variety of types of personal protection devices.

In accordance with the present invention, there is provided a disarming device for a portable personal protection apparatus which includes a housing enclosing the protection apparatus, an operating mechanism on the housing which is displaceable relative to the housing for displacing an actuator mechanism, an arming mechanism removably supported on the housing wherein the arming mechanism disables the operating mechanism or the housing when the arming mechanism is removed from the housing.

In accordance with the present invention, the operating mechanism is easily and rapidly armed and disarmed by respectively inserting and removing the arming mechanism from the housing.

In accordance with another aspect of the present invention, the housing has an interior compartment which replaceably houses an aerosol canister, electric shock mechanism or other type of protective apparatus. The housing may also be configured with an exterior gripping surface that can be comfortably grasped in the hand of the user.

In accordance with still another aspect of the present invention, the disabling mechanism includes a catch member which disables the operating mechanism when the arming mechanism is removed from the housing.

In accordance with yet another aspect of the present invention, the housing includes a secondary arming mechanism to enable the operating mechanism when the arming mechanism is removed from the housing.

In accordance with another aspect of the present invention, the operating mechanism includes a locking mechanism to place the operating mechanism in an operable and inoperable setting.

The primary object of the present invention is the provision of an improved housing for personal protection devices.

Another object of the present invention is the provision of an improved arrangement for easily disarming the personal protection device to render such device ineffective or inoperable when removed from the authorized user or from its storage location without permission from the authorized user.

Yet another object of the present invention is the provision of an improved protection device housing which is quicker and easier to be unarmed and armed by the authorized user than with devices heretofore available.

Still another object of the present invention is the provision of a protection device housing which includes a novel secondary arming mechanism to allow the authorized user to arm the protection device after such device has been disarmed by the primary disarming mechanism.

A further object of the present invention is the provision of a protection device housing of the foregoing character adopted to accommodate an electric shock mechanism or a chemical spray or aerosol container.

Another object of the present invention is the provision of an improved aerosol or spray housing which facilitates quicker and more efficient orientation and actuation of the aerosol or spray container.

Yet another object of the present invention is the provision of an aerosol or spray housing which replaceably contains a conventional aerosol or spray container and which holder is provided with an improved locking mechanism to prevent the inadvertent or unintentional actuation of the contained aerosol or spray container.

BRIEF DESCRIPTION OF THE DRAWINGS

The foregoing and other objects and advantages of the present invention will become more apparent from the following description taken together with the accompanying drawings in which:

FIG. 3 is a plan view in section taken along line 3—3 in FIG. 2;

FIG. 4 is a detail plan view in section taken along line 4—4 in FIG. 2;

FIG. 5 is a rear elevation view of the housing taken along line 5—5 in FIG. 2;

DESCRIPTION OF PREFERRED EMBODIMENTS

Figure 1:
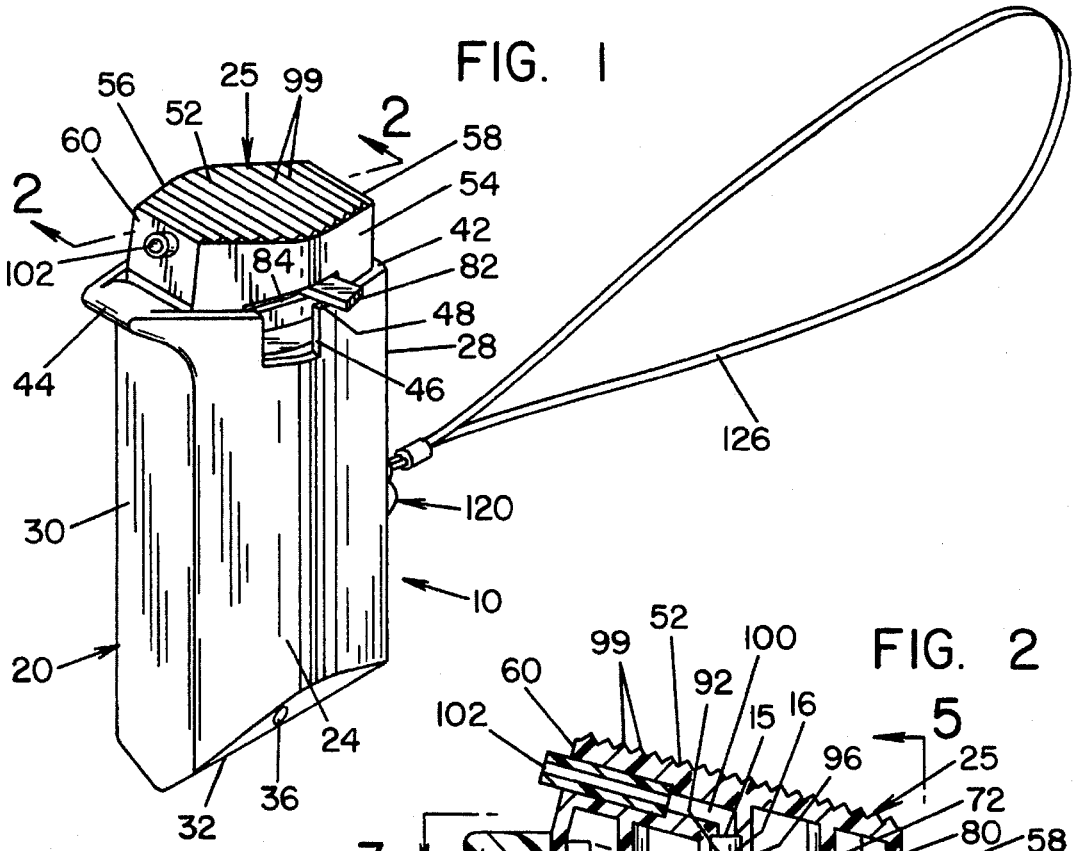
FIG. 1 is a perspective view showing a housing according to the present invention.

Referring now to the drawings wherein the showings are for the purpose of illustrating preferred embodiments of the invention only and not for the purpose of limiting the same, FIGS. 1–10 show a housing 10 in accordance with the present invention and which, in this embodiment, encloses a removable aerosol container 12 containing a material under pressure to be dispensed therefrom. The aerosol container 12 contains and dispenses various types of products including personal defensive sprays. As shown in the drawings, the container is typically cylindrical in shape and the contents thereof are released at nozzle 15 when the stem or plunger 16 is depressed causing valve 18 to open. The pressurized contents of the container are released as long as the stem 16 is maintained in its downwardly depressed position. The general construction of the aerosol container, as described above, is conventional and well known to those in the art.

Housing 10 includes an elongated body 20 having opposite side walls 24 and 26, rear wall 28 and front wall 30. Bottom wall 32 extends across the lower end of the housing and includes internal ribs 33 closely adjacent to the bottom of container 12. The walls 24 and 26 are shown as being slightly outwardly convex and along with the rear and front walls define a grip which may be conveniently grasped by the fingers of the user with the thumb extending around one side. An aperture 36 is shown extending transversely through the bottom wall to provide a convenient means of attaching a key ring.

The upper open end of the housing is defined by a peripheral edge 42 which inclines downwardly in the direction from front wall 30 toward rear wall 28. Edge 42 flares or projects forwardly at the upper end of wall 30 defining a lip 44 beneath which the first finger of the user normally rests when the device is grasped. Lip 44 may include grooves not shown, to improve the grip of the user on housing 10. The lip is configured so that it can be oriented tactilely so that when properly grasped, the pressurized contents of container 12 are discharged towards an assailant and slightly upwardly and away from the user. A recess 46 intercepts edge 42 and extends downwardly in side wall 24. A horizontal land 48 is provided along a portion of edge 42 immediately adjacent recess 46 and serves as a stop for downward movement of a radial projection 82 of a locking ring member 80 associated with a cap 25 of housing 10 as described in greater detail hereinafter.

Figure 2:
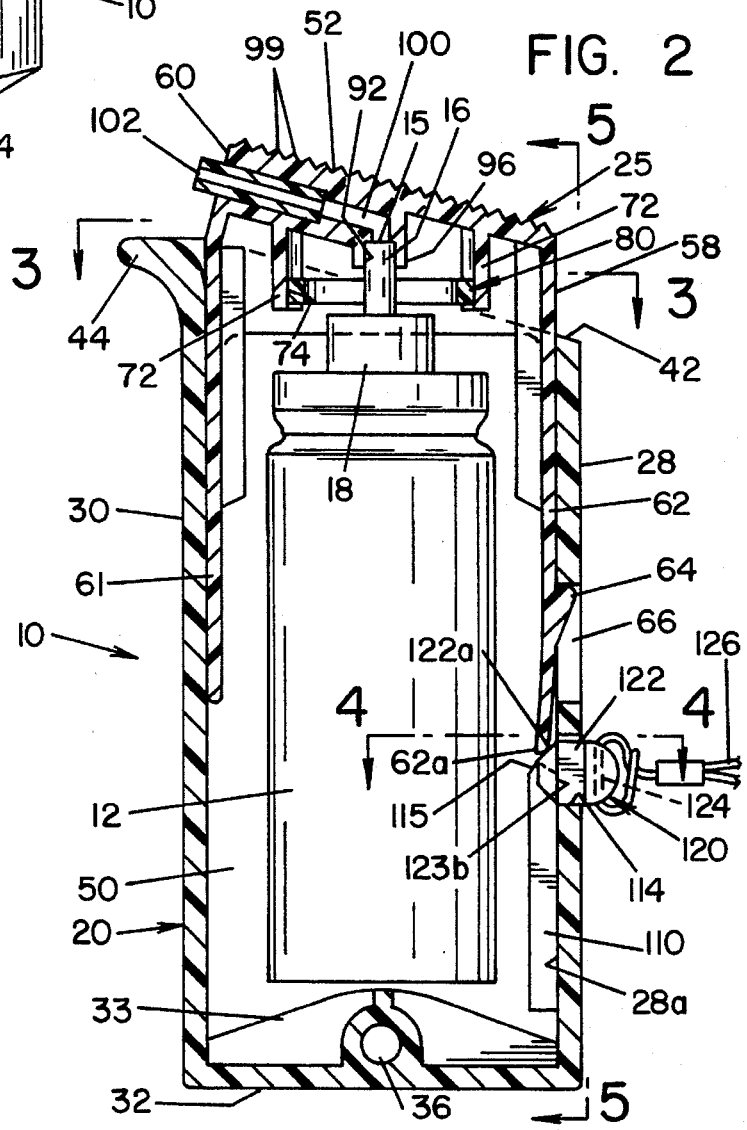
FIG. 2 is a sectional elevation view taken along line 2—2 in FIG. 1 and showing an aerosol or spray container in the holder.

Referring now in particular to FIGS. 2–4, body 20 defines an interior chamber 50 which replaceably receives container 12. The interior surfaces of opposite walls 24 and 26 are spaced apart to allow easy insertion and removal of the container and are slightly convex to snugly retain the container in the central position in chamber 50 and still allow the container to be removed and replaced. The cap 25 includes a cap portion 52 having opposite side walls 54 and 56, rear wall 58 and front wall 60. The cap further includes a pair of opposed legs 61 and 62 extending downwardly from walls 60 and 58, respectively, and which are slidably engagable along the interior sides of front and rear walls 30 and 28, respectively, of housing 10. The cap is retained in place by a detent 64 on leg 62 which, in the assembled position, is received within slot 66 which extends axially in housing wall 28. Preferably, the cap and the housing are fabricated from a suitable material such as molded plastic and the downwardly extending legs 61 and 62 have some flexibility so that assembly of the cap and the housing are easily accomplished as legs 61 and 62 will flex inwardly as the cap is inserted into the housing allowing detent 64 to become engaged in slot 66. In this position, and as will be described hereinafter, cap 25 may be pushed downward relative to housing 20, guided by the position of the detent 64 within slot 66.

The interior of the cap has downwardly projecting bosses 72 which together define a seat 74 which supports locking ring member 80 relative to the cap. Ring member 80 is annular and has a radial projection 82 which extends outwardly through a slot 84 in side wall 54 of the cap. Slot 84 permits the locking ring to be rotated from a locked position to an unlocked position as respectively shown in FIG. 3 in solid and broken lines. Ring member 80 may also include a protrusion 85 to fictionally engage with one of the bosses 72 to prevent locking ring member 80 from loosely rotating from the locked and unlocked positions. The cap also includes an axially extending bore 92 which is circular in cross-section and is adapted to align with and receive the outer end of valve stem 16 of container 12. Bore 92 is defined by an annular boss 96 having a lower end which, in the normal assembled position, is concentrically positioned within annular locking ring 80. In the assembled position, the upper end of the stem 16 abuts or is closely adjacent the bottom of bore 92 so that downward movement of the cap 25 will depress stem 16 to actuate valve 18 releasing the contents of container 12. The upper surface 52 of the cap forwardly inclines and has a plurality of transversely extending ridges 99 to enhance operation by making surface 52 easily identifiable by touch.

In use, the user may easily disassemble the device by pressing detent 64 inward slightly to deflect leg 62 permitting the cap to be withdrawn from the housing. A suitable aerosol container 12 may be placed in the interior chamber 50 of the housing with the bottom of the canister of the container resting against or suspended slightly above inner side of bottom wall 32. In this position, the central valve stem 16 will project axially upward. The cap may then be re-positioned with respect to the housing by aligning legs 60 and 62 against the interior surfaces of walls 30 and 28. Downward force will bring the detent 64 into engagement with its associated slot 66. In the normal stored position, as in a handbag or pocket, locking ring 80 will be in the position shown in FIG. 1 with the projection 82 engaging the land surface 48 located on the upper edge 42 of the housing. The engagement of the projection against the land 48 will resist downward, actuating force on the cap and thereby minimize the possibility of inadvertent or intentional actuation of the aerosol cannister.

Figure 6:
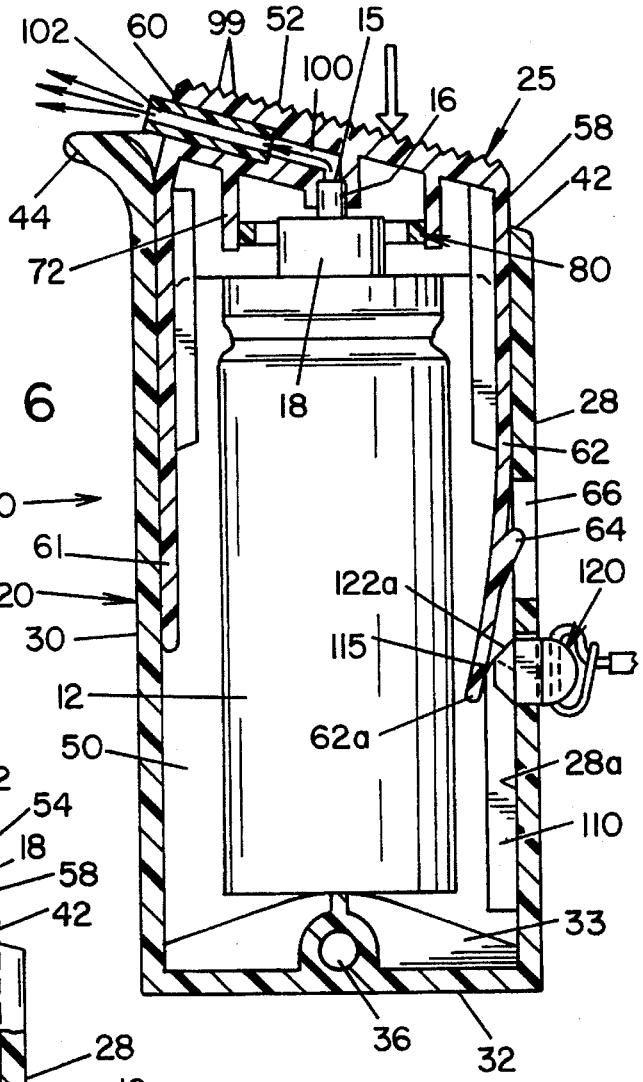
FIG. 6 is a sectional elevation view similar to FIG. 2 showing the housing with the cap depressed in an actuated position.
Figure 7:
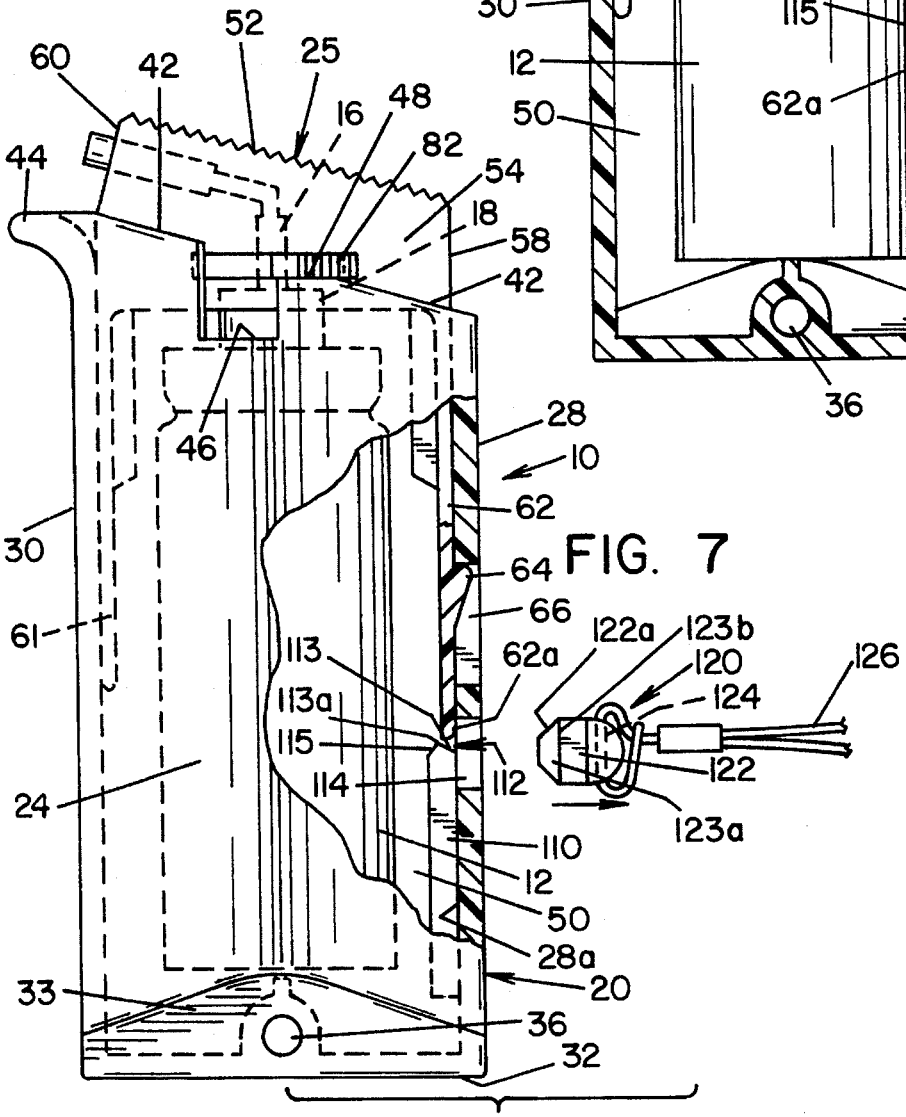
FIG. 7 is an sectional view, partially in section, showing the housing in a disarmed position by the removal of the disarming member.

Holder 10 also includes a disarming mechanism. As best illustrated in FIGS. 2, 4, 6 and 7, inner surface **28*a* of rear wall 28 includes a pair of vertically extending catch members 110 located below slot 66. Catch members 110 are laterally spaced apart and parallel to one another and each catch member includes a catch notch 112 at the top of the catch member. Catch notch 112 includes two sloped surfaces, namely surface 113 extending upwardly and inwardly from inner surface 28*a* of rear wall 28 and surface 115 which slopes downwardly and inwardly from inner end 113*a* of surface 113. Housing 20 further includes a pair of openings 114 through rear wall 28 below slot 66. Openings 114 are positioned laterally between the two catch members 110 and partially overlap the upper ends of members 110 and thus notches 112 as illustrated in FIG. 7. The two openings 114 insertably receive a removable disarming member 120. Disarming member 120 includes a pair of laterally spaced apart protrusions 122 which are aligned with and sized to fit into openings 114. Each protrusion, when inserted through opening 114, extends beyond inner surface 28*a* of wall 28 and has a downwardly sloped upper surface 122*a* which extends from inner surface 28*a* so as to be co-planar with sloped surface 115 of the adjacent catch member 110 for the purpose set forth hereinafter. At the end of protrusion 122 is a clasp member 123 which includes an abutment surface 123*b* which abuts against inner surface 28*a* when the disarming member is inserted into openings 114. The clasp member secures disarming member in openings 114. The clasp member also includes sloped sides 123*a* to facilitate insertion into openings 114. Protrusions 122 are preferably made of a flexible plastic so that protrusions flex laterally inward when the disarming member is inserted and removed from openings 114. Removable member 120 includes a hole 124 receiving a wrist strap or tether line 126** therethrough. The wrist strap or tether line is connected to the authorized user by the user inserting his/her hand through the wrist strap so that the wrist strap is relatively snug around the wrist.

As best illustrated in FIG. 2, when removable disarming member 120 is inserted into openings 114 the inclined surfaces 122*a* thereof engage the lower end 62*a* of cap leg 62. The authorized user, prior to depressing cap 25, inserts his/her wrist into wrist strap 126 and grasps housing 10 such that lip 44 is facing away from the user and toward the intended target. Once the user has properly aimed the housing, locking ring member 80 is slidably positioned into the unlocked position overlying recess 46 to allow radial projection 82 to move into recess 46 when cap 25 is depressed. When cap 25 is depressed, leg 62 is cammed inwardly by surfaces 122*a* and 115 and slidably moves downwardly thereof as shown in FIG. 6. During this movement, container 12 engages bottom wall ribs 33 and cap 25 pushes valve stem 16 downwardly, opening valve 18 of container 12, thereby discharging the fluid in the container through passage 100 and discharge nozzle 102.

Figure 8:
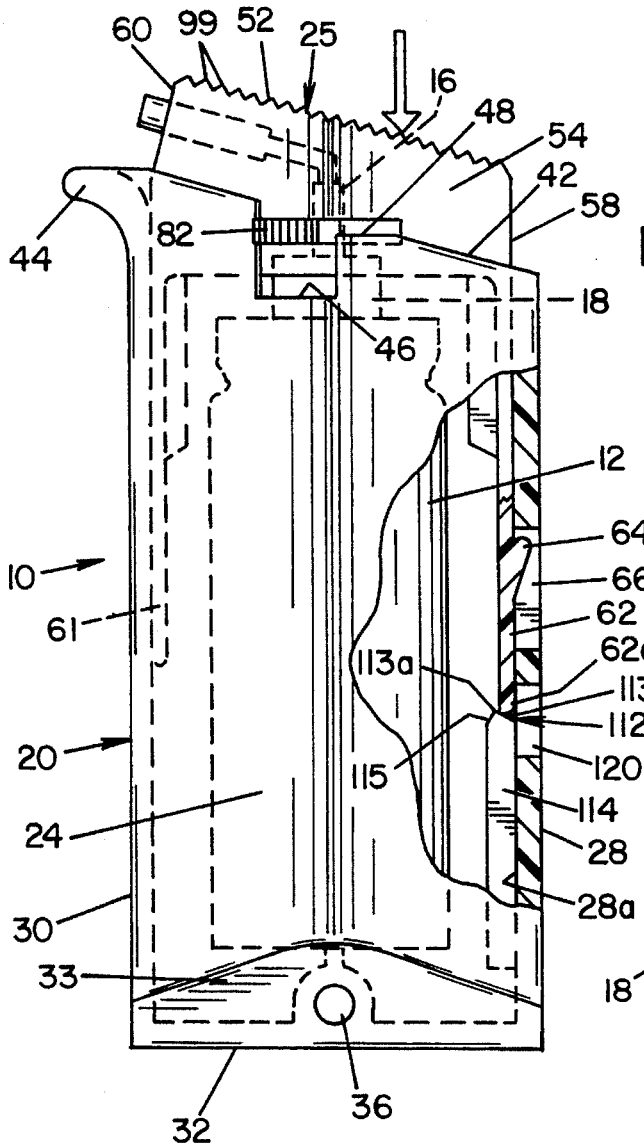
FIG. 8 is an elevation view similar to FIG. 7 showing the housing with the cap held against depression in the disarmed position.

FIGS. 7 and 8 illustrate the disarming of housing 10. Housing 10 is disarmed by removing arming member 120 from rear wall 28. The arming member can be easily removed by the authorized user by pulling on wrist strap or tether line 126. The holder will also be automatically disarmed if the holder is physically taken from the user by grabbing the holder and pulling it away from the user. As the holder is being taken away from the user, the wrist strap will remain on the user's wrist, thereby removing the arming member attached to the wrist strap from the housing rear wall. As will be come apparent hereinafter, once the arming member is removed from the housing, the assailant who has taken the holder cannot actuate the spray canister thereby rendering the security device ineffective and inoperable.

FIGS. 7 and 8 best illustrate how the removal of arming member 120 from rear wall 29 of housing 10 disarms the security device. When the arming member is removed, the lower end 62*a* of cap leg 62 is released from the position shown in FIG. 2 and moves against inner surface 28*a* of rear wall 28 so as to be vertically above catch notch 112 of catch member 110. When cap 25 is then depressed, the edge 62*a* of leg 62 contacts upwardly sloped surface 113 and is cammed into catch notch 112. Notch 112 and leg end 62*a* thereby prevents further downward movement of the cap and prevents cap 25 from pushing valve stem 16 to discharge fluid in the container.

The security device can be rearmed by the authorized user by inserting disarming member 120 into the housing at opening 114. Once the disarming member is inserted into the housing, the lower edge of leg 62 will be once again be deflected by protrusion 122 to the position shown in FIG. 2 thereby allowing cap 25 to push valve stem 16 to discharge the container fluid as described above.

Figure 9:
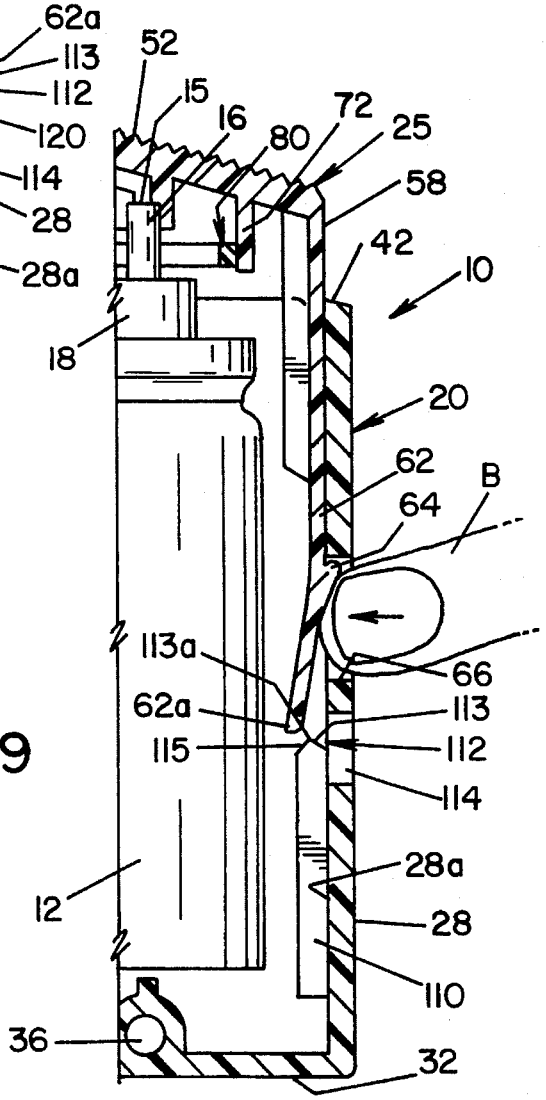
FIG. 9 is a section view similar to FIG. 8 showing manual rearming of the holder.
Figure 10:
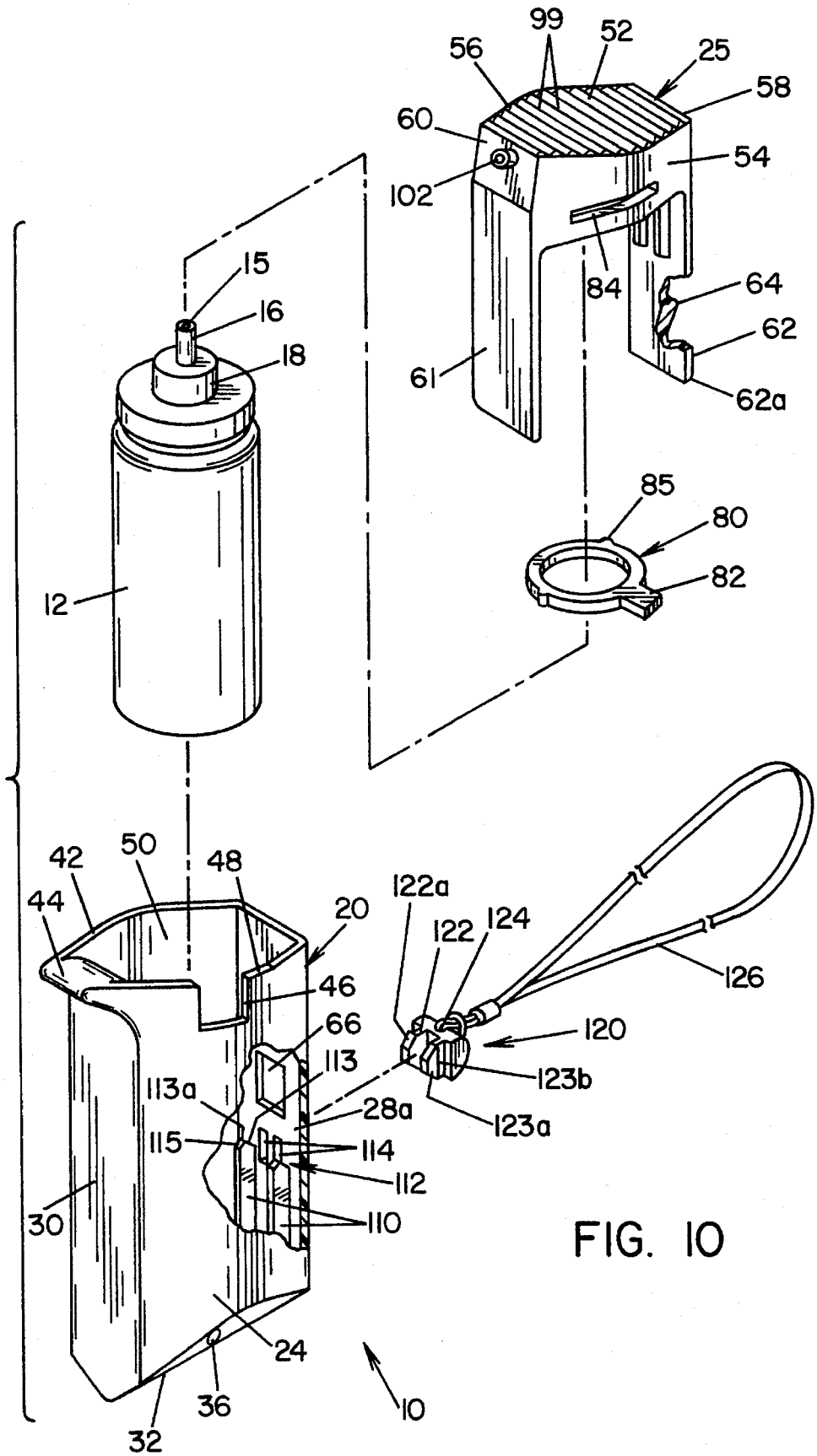
FIG. 10 is an exploded view of the component parts of the housing and aerosol or spray container.

FIG. 9 illustrates the manner in which the contents in the container can be discharged even when the disarming member has been removed from rear wall 28. In this respect, the user can place his or her finger B through slot 66 to deflect the lower edge 62*a* of leg 62 from catch notch 112 and subsequently depress cap 25 to release the fluid in container 12.

Figure 11:
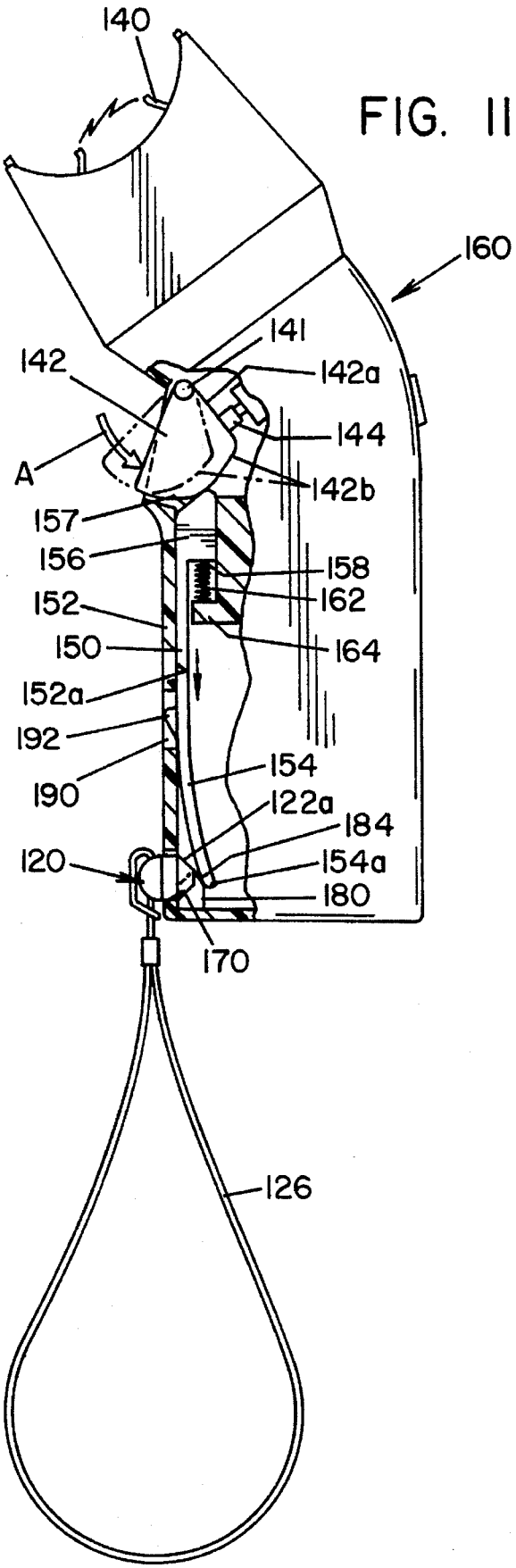
FIG. 11 is an elevation view partially in section, showing an alternative embodiment of the present invention; and, FIG. 12 is an elevation view similar to FIG. 11 showing the housing in the disarmed mode by the removal of the disarming member.
Figure 12:
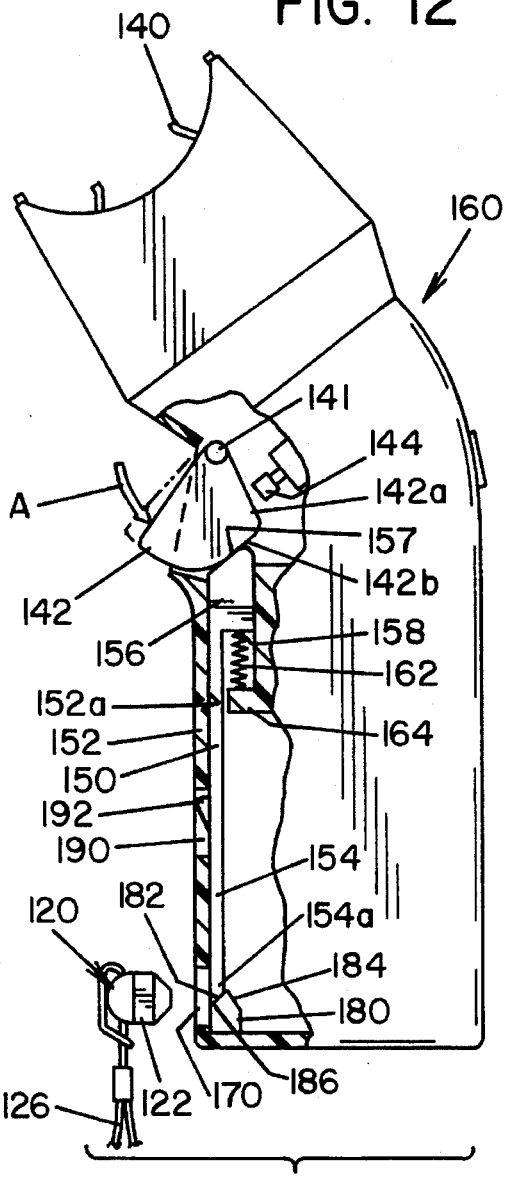

FIGS. 11 and 12 illustrate another embodiment of the invention whereby an electric shock device or stun gun is encased in housing 160. The general construction of a stun gun is well known to those in the art. As is well known, a stun gun operates by discharging a high voltage, low current charge on an assailant thereby temporarily rendering the assailant immobile. The charge is transferred to the assailant by touching the assailant with electrodes 140. The electrodes are energized by the authorized user depressing trigger 142 which pivots on pin 141 and the back surface 142*a* of trigger 142 contacts switch button 144.

A disarming mechanism is incorporated in housing 160 as shown in FIGS. 11 and 12. In this respect, a leg member 150 is vertically slidably supported adjacent the inner surface 152*a* of front wall 152 of holder 160. Leg member 150 includes a head 156 at the upper end thereof and a downwardly extending portion 154 having a lower end 154*a*. Head 156 has an upper sloped surface 157 and a base surface 158 and is biased in a upward direction by spring 162 acting against base surface 158 to maintain sloped surface 157 in contact with trigger 142. The lower end of spring 162 is supported by spring support 164. Housing 160 includes a pair of openings 170 only one of which is visible in FIGS. 11 and 12. Opening 170 corresponds in shape and size to openings 114 on housing 20 as previously described and shown. The openings 170 receive a removable arming member 120 which is structured as described hereinabove. Accordingly, like numerals appearing in FIGS. 11 and 12 with regard to the structural components of arming member 120. Attached to inner surface 152*a* of front wall 152 is a pair of catch member 180 only one of which is visible. The catch members are similar to catch members 110 described herein and in this respect include an upward sloped surface 182 defining a catch crevice 186 with inner surface 152*a* of front wall 152, and a sloped surface 184 extending downwardly and inwardly from the upper end of surface 182. When arming member 120 is inserted into openings 170, as seen in FIG. 11, protrusions 122 extend into the interior of housing 160, whereby surfaces 122*a* and 184 form a continuous downwardly and upwardly sloped surface from the inner surface of front wall 152.

As illustrated in FIG. 11, when trigger 142 is depressed in the direction of arrow A, the trigger surface 142*b* engages head 156 and displaces leg 150 downwardly. As the leg is pushed downwardly, the lower edge 154*a* of portion 154 moves toward and is deflected inwardly by surfaces 122*a* and 184 from catch crevice 186 thereby allowing trigger 142 to contact switch button 144 and activate the stun gun. The stun gun is simply disarmed by removing removable member 120 from housing 160 as shown in FIG. 12 and as described herein with regard to FIGS. 7 and 8. In the disarmed mode, trigger 142 is precluded from contacting switch button 144. In this regard, as trigger 142 is depressed, lower edge 154*a* of elongated section 154 moves toward catch members 180 and contacts upwardly sloped surfaces 182 thereof. Sloped surfaces 182 directs edge 154*a* into crevice 186 whereby leg member 150 is prevented from moving further downward. This in turn prevents further movement of trigger 142 toward switch button 144. The stun gun is rearmed by inserting arming member 120 into openings 170 in housing 160. Front wall 152 includes a slot 190 which enables activating the stun gun when arming member 120 is removed from housing 160. The slot in the housing is sized to allow the user to insert his/her finger into the slot and deflect leg portion 154 inwardly to preclude end 154*a* entering crevice 186 when trigger 142 is depressed. Preferably, leg portion 154 includes a detent 192 extending into slot 190 to facilitate such deflection of portion 154.

The invention has been described with reference to preferred embodiments and it is apparent that many modifications may be made with respect to the preferred embodiments and that other embodiments can readily be devices without departing from the principles of the invention. Therefore, it is to be distinctly understood that the foregoing descriptive matter is to be intended merely as illustrative of the invention and not as a limitation.

Having thus defined the invention, the following is claimed:

1. A disarming device for a portable personal protection apparatus comprising housing means for at least partially enclosing said personal protection apparatus, actuator means including a leg on said housing means and displaceable relative thereto for for activating said personal protection device, and arming means removably supported on said housing for disabling and enabling said actuator means and interacting with said leg, said arming means including an arming member which disables said actuator means when removed from said housing means.

2. The disarming device as defined in claim 1, wherein said actuator means moveable between a first position and a second position whereby movement to said second position activates said apparatus.

3. A disarming device for a portable personal protection apparatus comprising housing means for at least partially enclosing said personal protection apparatus, actuator means on said housing means and displaceable relative thereto for activating said personal protection device, and arming means removably supported on said housing for disabling and enabling said actuator means, said arming means including an arming member and a catch member, said arming member disabling said actuator means when removed from said housing means, said disabling means includes a catch member engaging said actuator means preventing activation of said apparatus when said arming member is removed from said housing.

4. The disarming device as defined in claim 3, wherein said arming means includes a tether member.

5. The disarming device as defined in claim 4, wherein said tether member is in the form of a wrist loop.

6. The disarming device as defined in claim 1, wherein said housing means includes an opening which supports said arming member.

7. The disarming device as defined in claim 1, including a bypass means for activating said apparatus when said arming member is removed from said housing means.

8. The disarming device is defined in claim 3, including a bypass means for activating said apparatus when said arming member is removed from said housing means.

9. The disarming device as defined in claim 1, wherein said apparatus is a spray device for discharging spray material.

10. The disarming device as defined in claim 1, wherein said apparatus is an electrical shock device.

11. The disarming device as defined in claim 9, wherein said housing defining an interior compartment having an open end adapted to receiving a container containing a spray, said operating means including a cap positioned at the open end of said housing, said cap having a passageway directing the spray from said canister through said cap.

12. The disarming device as defined in claim 11, including locking means for controlling movement of said actuator means relative to said housing means, said locking means moveable between a first and a second setting, said first setting preventing movement of said actuator means relative to said housing means.

13. The disarming device as defined in claim 12, wherein said locking means comprising a locking ring rotatably disposed to said actuator means and having a projection moveable between said first and second settings.

14. The disarming device as defined in claim 1, including a key ring securable to said housing means.

15. A disarming device for a portable personal protection apparatus comprising:

(a) housing means for substantially enclosing said personal protection apparatus;

(b) actuator means incorporated in said housing means and displaceable relative thereto for activating said personal protection apparatus, said actuator means including a leg moveable between a first position and a second position, said second position activating said personal protection apparatus; and (c) arming means supported on said housing means for enabling and disabling said actuator means and interacting with said leg, said arming means including an arming member removably supported on said housing means, said arming means preventing movement of said actuator means to said second position when said arming member is removed from said housing means.

16. The disarming device as defined in claim 15, wherein said housing means includes a bottom wall and sidewalls integral therewith defining an interior compartment for personal protection apparatus.

17. The disarming device as defined in claim 16, wherein said housing means being in sliding contact with said actuator means.

18. The disarming device as defined in claim 17, wherein said leg is disposed adjacent to said side wall.

19. The disarming device as defined in claim 15, wherein said arming device includes catch means for engaging said actuator means thereby preventing movement of said actuator means to said second position when said arming member is removed from said housing means.

20. The disarming device as defined in claim 18, wherein said arming device includes catch means for engaging said actuator means thereby preventing movement of said actuator means to said second position when said arming member is removed from said housing means.

21. The disarming device as defined in claim 20, wherein said catch means disposed on said side wall for engagement of said leg when said arming member is removed from said housing means.

22. The disarming device as defined in claim 15, including locking means for controlling movement of said actuator means, said locking means moveable between a first setting and a second setting, said first setting preventing movement of said actuator means to said second position.

23. The disarming device as defined in claim 21, including locking means for controlling movement of said actuator means, said locking means moveable between a first setting and a second setting, said first setting preventing movement of said actuator means to said second position.

24. The disarming device as defined in claim 23, wherein said locking means includes a locking ring rotatably disposed to said actuator means and having a projection moveable between a first location and a second location, said first location corresponding to locking means first setting and said second location corresponding to said locking means second setting.

25. The disarming device as defined in claim 15, wherein said personal protection apparatus is a cannister of fluid.

26. The disarming device as defined in claim 15, wherein said personal protection apparatus is an electrical shock device.

27. The disarming device as defined in claim 15, including bypass means incorporated in said housing means for allowing movement of said actuator means to said second position when said arming member is removed from said housing means.

28. The disarming device as defined in claim 21, including bypass means incorporated in said housing means for allowing movement of said actuator means to said second position when said arming member is removed from said housing means.

29. The disarming device as defined in claim 28, wherein said bypass means facilitating movement of said leg about said catch means when said arming member is removed from said housing means.

30. The disarming device as defined in claim 29, wherein said bypass means includes opening means in said sidewall of said housing for access to said leg.

* * * * *